United States Patent [19]

Keiser et al.

[11] 4,256,302

[45] Mar. 17, 1981

[54] VARIABLE RESISTANCE EXERCISING DEVICE

[76] Inventors: Dennis L. Keiser, 14634 E. Annadale, Sanger, Calif. 93657; Gideon B. Ariel, 95A Poole St., Belchertown, Mass. 91007

[21] Appl. No.: 665,459

[22] Filed: Mar. 10, 1976

[51] Int. Cl.[3] ..... A63B 21/06

[52] U.S. Cl. ..... 272/118; 272/DIG. 4; 272/134; 272/144

[58] Field of Search ..... 272/118, 93, 94, 96, 272/116, 117, DIG. 4, DIG. 5, 131, 134; 128/25 R; 273/55 A; 124/86

[56] References Cited

U.S. PATENT DOCUMENTS

| | | | |
|---|---|---|---|
| 3,640,527 | 2/1972 | Proctor | 272/118 |
| 3,734,495 | 5/1973 | Nist et al. | 272/118 |
| 3,850,431 | 11/1974 | Winans | 272/118 |
| 3,912,261 | 10/1975 | Lambert | 272/118 |
| 3,945,368 | 3/1976 | Jones | 124/86 |

FOREIGN PATENT DOCUMENTS

| | | | |
|---|---|---|---|
| 1405836 | 9/1973 | United Kingdom | 272/118 |

*Primary Examiner*—William R. Browne
*Attorney, Agent, or Firm*—Paul L. Gardner

[57] ABSTRACT

An improved exercising device for exercising the legs of a user includes a frame member with a lever arm having one end pivotably attached thereto. The lever arm extends downwardly from the portion of the frame member to which it is pivotably connected, and a pair of foot-engaging force transfering members are mounted on the lower end of the lever arm. A cable has one end pivotably connected near the lower end of the lever arm, passes around an eccentrically mounted pulley and has its other end connected to weights. As the user lifts the lower portions of his legs, the lever arm is pivoted to pull the cable and the weights attached thereto, thereby strengthening the knee muscles of the user. The eccentrically mounted pulley varies the resistance to movement of the user's lower legs initially increasing the resistance and then decreasing the resistance in a sinusoidal manner as the lower legs are lifted to pivot the lever arm and lift the weights.

5 Claims, 7 Drawing Figures

FIG. 3
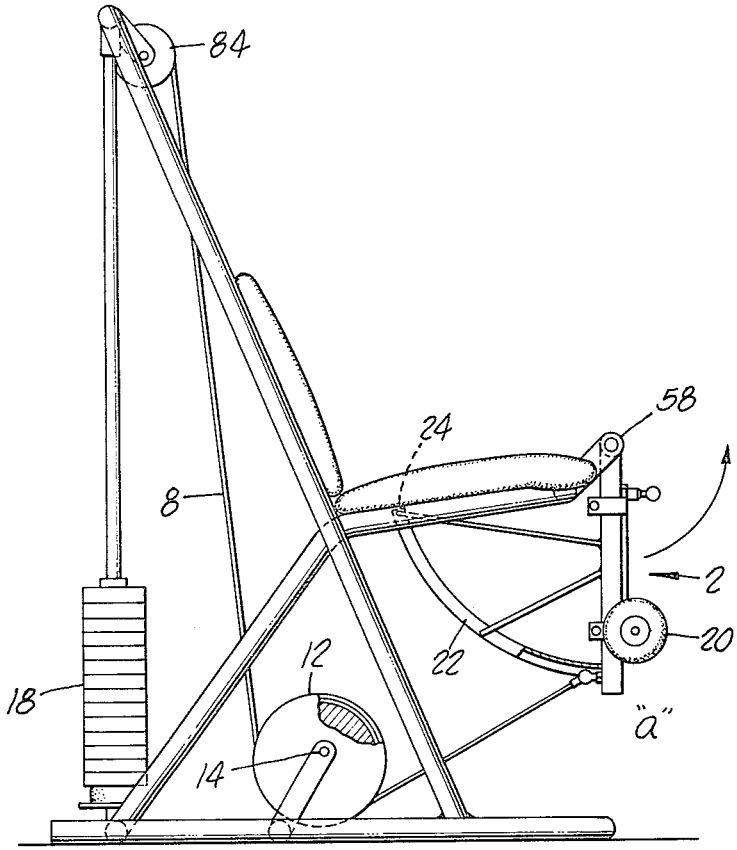
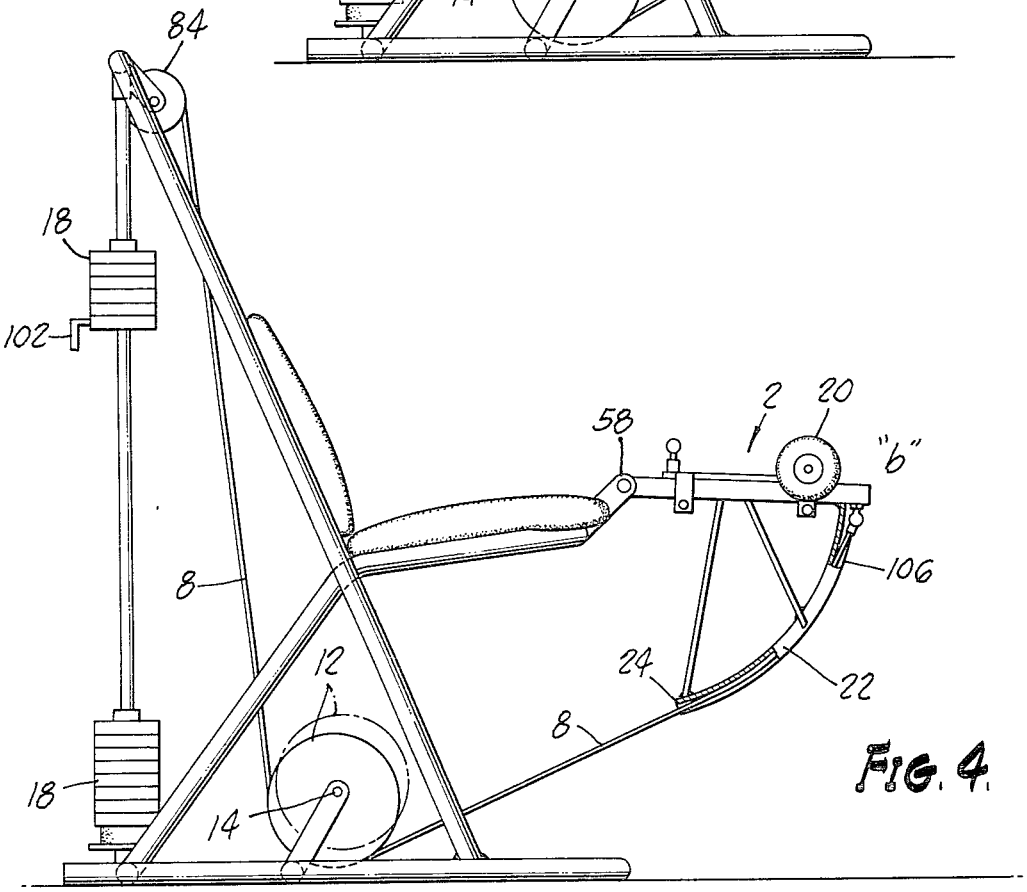
FIG. 4

VARIABLE RESISTANCE EXERCISING DEVICE

BACKGROUND OF THE DISCLOSURE

The present invention relates to an exercising device particularly a device for strengthening the muscles associated with the thigh and knee.

Due to the proliferation of contact sports such as football among large masses of the population of this and other countries, a marked increase in the damage being sustained in the knee joint have been evidenced. Physical therapists and trainers have been constantly faced with dealing with damage to the knee joint arising from excessive forces and moments of force in the vicinity of the knee joint.

To strengthen the muscles associated with the knee joint three principle exercises have been used during rehabilitation therapy and knee strengthening.

The most common type of knee strengthening exercise employs the use of a weighted boot, or shoe. The injured person sits in a chair with his injured foor or feet bent so as to be in a normal sitting position. To strengthen and exercise the muscles associated with the knee joint the injured leg would be lifted to its extended position, opposing the downward force of the weighted boot or shoe. This exercise is repeated a number of times, with increasing weight, thereby strengthening the knee joint.

A disadvantage of the use of the weighted boot or shoe involves the undesirable effect of momentum reducing the effective muscular effort required to move the weighted boot or shoe from its bent to its extended position. As the weighted shoe is initially raised from its bent position the muscular activity increases until the momentum of the weighted shoe overcomes the downward force of the weighted shoe so that the shoe actually causes the lower portion of the leg to rise without the requirement of any muscular activity, much as in a pendulum-type movement. Once the weighted boot or shoe begins to swing the "pendulum" nature of the shoe greatly reduces the muscular activity, thereby defeating its initial purpose.

A second method widely used in knee rehabilitation therapy employs the use of a pulley system. An ankle cuff is attached to the injured leg of the user and a cable is connected to the ankle cuff. The cable is passed over a pulley and connected to a weight, typically located behind the user. The user bends his leg and attempts to extend the leg to its straight position, overcoming the restrictive force of the weight.

The disadvantage of the "pulley system" results from the variation of the resistance experienced by the user as the leg travels from its bent position to its extended position. This is the result of the change of the force applied to the ankle as the leg changes its position. When the leg is in its bent position the angle formed between the lower portion of the leg and the cable is approximately 90 degrees. As the leg is raised to its fully extended position the angle between the lower portion of the leg and the cable may be reduced to as little as 20 degrees. The change in angle of this applied force results in the force exerted against the leg when fully extended being only 25% of the resistance applied to the leg when in its fully bent position.

In addition, as in the case of the weighted shoe, the "pendulum" effect further reduces the muscular effort required to oppose the resistive forces of the weights as the leg is moved. With faster movement the deceleration of the leg increases towards the end of its movement, resulting in greatly reduced muscular activity.

Other exercising machines for strengthening the muscles associated with the knee joint also have been available. The disadvantages discussed concerning the exercising devices using the pulley system also occur in the exercising machine, namely the angle between the lower portion of the leg and the restraining force changing as the lower portion of the leg is extended and the "pendulum" effect of the member. Such exercising machines normally comprise a chair-like structure having a lever arm assembly pivotable about a pivot point. The lever arm assembly is located in front of the user's ankles. The user attempts to lift the lever arm assembly by applying pressure to a cushioned projection with the user's ankle. The lever arm assembly is connected to a system of weights for opposing the movement of the lever arm.

A disadvantage of the previously available knee exercising devices was a lack of means for varying the effective resistance experienced by the muscles of the knee as the knee is moved from the bent position to its extended position in the most beneficial manner.

In addition, the previously available exercising devices did not provide for the maximization of the participation of involvement of the muscles associated with the knee joint at various positions of movement of the leg during the bending and lifting activity. As indicated above, the involvement of the muscles associated with the knee during the latter degree of movement of the knee is minimal, due at least in part to the "pendulum" effect discussed previously.

In association with the present invention it has been observed that the involvement of the muscles associated with the knee joint decreases as the lower portion of the leg is initially lifted until such involvement reaches a minimum after about 10 degrees of movement. The involvement of the muscles associated with the knee joint thereafter rises in a sinusoidal manner until a maximum involvement is reached when the angle of movement of the lower portion of the leg approaches approximately 70 degrees. Thereafter the involvement of the muscles once again begins to decrease, again in a substantially sinusoidal manner until the knee is entirely extended. Thus the degree of involvement of the muscles associated with the knee joint follows what may be described as a substantially sinusoidal curve displaced approximately 180 degrees.

In the present invention the force applied to the lower portion of the leg by the exercising machine is varied in such a manner as to provide a substantially uniform effective force to the muscles associated with the knee joint by increasing the applied force in those portions of the movement of the lower portion of the leg where the muscular involvement is less than the optimum, and to reduce the resistance where the involvement of the muscles associated with the knee joint are substantially optimum.

In the preferred embodiment of the invention an off-centered cylindrical member serves as a camming means for varying the effective force applied to the muscles associated with the knee joint. In addition, a guide means associated with a lever arm assembly is employed to maintain the angle at which force is applied to the lower portion of the leg substantially constant.

It is an object of the present invention to provide an exercising apparatus which operates more efficiently than previously available devices.

It is a further object of the present invention to provide a means for varying the effective resistive force experienced by a pivoting lever arm to be moved by the user.

It is another object of the present invention to provide a means for maintaining the angle at which a resistive force is applied to a pivoting member.

Still another object of the present invention is to provide a means for varying the resistive force applied to a pivoting member, such force being capable of being varied so as to optimize the involvement of the muscles associated with the knee joint in opposing the resistive force applied to such a member.

It is yet another object of the present invention to provide an exercising device which is particularly suited for strengthening the muscles associated with the knee joint which is simple to operate.

These and other objects of the present invention will become evident upon the reading of the following description and the accompanying drawings.

BRIEF DESCRIPTION OF THE DRAWINGS

FIG. 3 is a partially sectional side view of the preferred embodiment of the present invention with the pivotal lever arm assembly at its initial position.

FIG. 4 is a partial sectional side view of the present invention with the pivotal lever arm assembly fully extended.

DETAILED DESCRIPT OF THE INVENTION

Figure 1:
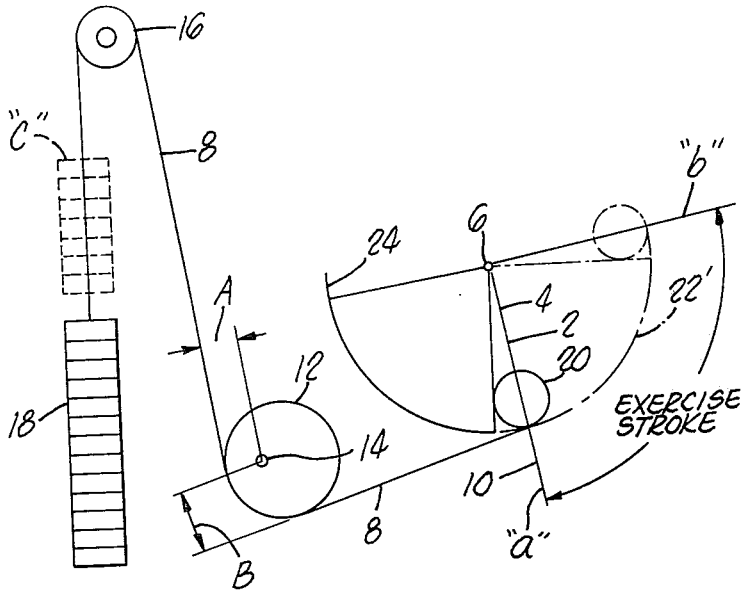
FIG. 1 is a diagramatic view of the exercising device of the present invention.

FIG. 1 is a diagramatic view of the operation of the exercising device of the present invention. A lever arm 2 is pivoted about one end 4 at pivot point 6. A substantially rigid cable 8 is attached proximate the opposite end of the lever arm 10. The cable 8 passes below a camming means 12 which comprises a cylindrical disc rotated about an axis 14 not on the center of the disc. The cable 8 is passed over an upper pulley 16 and connected to a series of weights 18. The amount of weight connected to the cable 8 may be varied by any number of conventional means.

Located at the lower end 10 of the lever arm assembly 2 are two cylindrical padded members 20 extending perpendicularly to the lever arm 2. The cylindrical padded members 20 are designed to comfortably engage the ankle of the user. An arcuate guide means 22 is affixed to the lever arm assembly 2 in a position so as to come into contact with the cable 8 upon rotation of the lever arm 2. The opposite end 24 of the arcuate guide means 22 serves to restrain any rotational movement of the lever arm assembly 2, in the counterclockwise direction when received as shown in FIG. 1.

In FIG. 1 the solid lines depict the apparatus at its initial position a. As the user places his ankles behind the cylindrical padded members and attempts to lift and straighten his legs the lever arm assembly 2 moves to a second position as shown by the broken lines b. The cable 8 is engaged by the arcuate guide means 22 depicted by broken lines 22 and the weights which are connected to cable 8 are raised to a position c. Upon release of force applied to the circular padded members 20 by the user's ankle the downward force of the weights 18 will return the lever arm assembly to its position a.

During the movement of the lever arm assembly 2 the camming means 12 is rotated about its axis of rotation 14 by the cable 8 resulting in the force of the weights applied to the lever arm assembly 2 being varied as the lever arm assembly 2 moves from position a to position b.

Figure 2:
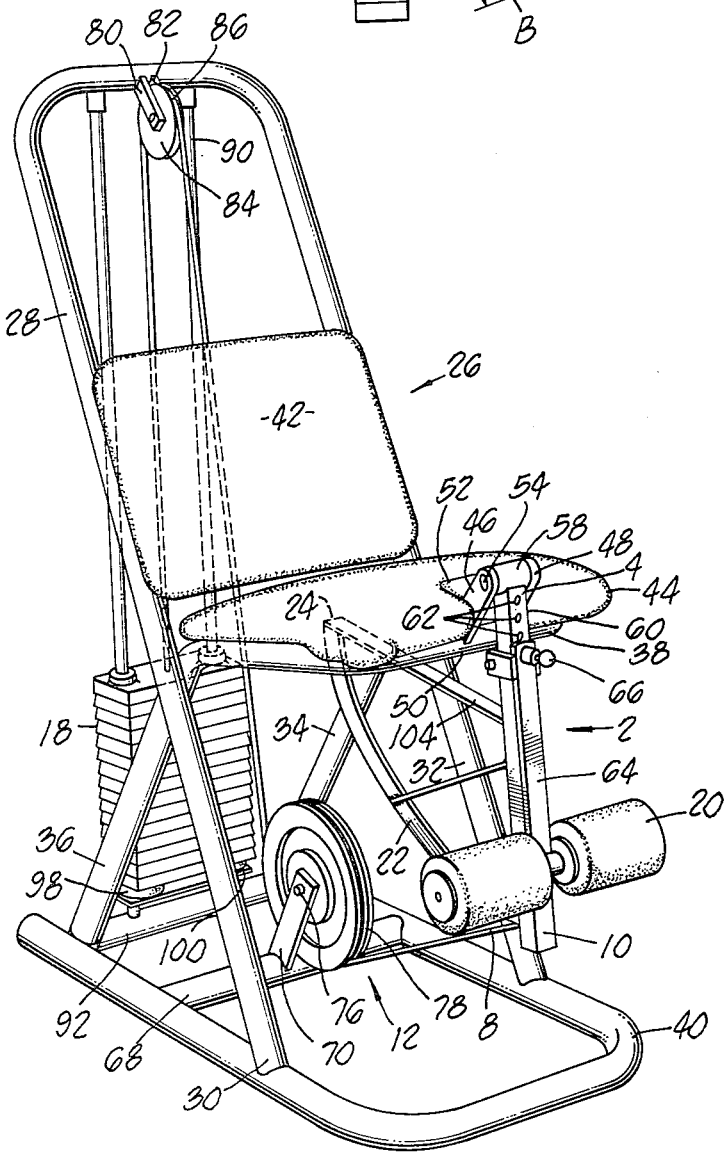
FIG. 2 is a perspective view of the preferred embodiment of the present invention.

Referring to FIG. 2, the exercising apparatus of the present invention comprises a chair-like structure 26 formed by an inverted U-shaped tubular member 28 which forms the front side legs 30 and 32 and the support frame for the back of the chair-like structure 26. A single tubular member also forms the rear side legs and the support frame for the seat portion 38. The front legs 30 and 32 and the rear legs 34 and 36 are mounted to a base frame 40 for supporting the chair-like structure 26. The base frame 40 extends in front of the front side legs 30 and 32 and behind the rear legs 34 and 36 in order to provide additional stability to the chair-like structure 26 in order to prevent the overturning of the chair-like structure 26 during use. A back cushion 42 and a seat cushion 44 are provided to complete the chair-like structure 26.

A pair of support members 46 and 48 extend outwardly and upwardly from the front 50 of the seat frame 38. The seat cushion 44 has a complimentary knotch 52 for fitting around the support members 46 and 48. The opposite ends of the pair of parallel support members 46 and 48 have a pair of aligned holes 54 and 56 (not shown). A cylindrical member 48 having complimentary sized male end portions fit within the holes 54 and 56.

A lever arm assembly 2 has one end fixed to the cylindrical member 58. The length of the lever arm assembly is adjustable. The lever arm assembly 2 comprises an interior longitudinal male member 60 having a plurality of detent means 62 spaced along the longitudinal length of the male member. A complimentary longitudinal female member 64 fits over the male member 60 in sliding engagement. A spring loaded pin assembly 66 passes through a hole in one wall of the female member 64 to fit within an associated detent means 62 to hold the male member 60 and the female member 64 in non-sliding engagement. The pair of cylindrical padded member 20 are fixed to the lower end of the lever arm assembly 2 perpendicular to the longitudinal axis of the lever arm assembly 2.

A camming means 12 is fixed upon a cross bar member 68 rigidly mounted between the sides of the base frame 40 on a pair of upwardly extending parallel support plates 70 and 72 (not shown) having holes 74 and 76 in the upper end of said support plate. The camming means 12 comprises a cylindrical disc mounted on an axle positioned off of the center of the disc and rotatably mounted in the holes 76 of the parallel support plates 70 and 72. The cylindrical disc has a grooved portion 78 about its circumference for receiving the cable 8.

Descending downwardly from the base of the U-shaped member 28 and forming a portion of the frame of the chair-like structure 26 are two parallel spaced support plates 80 and 82 for supporting a pulley member 84 rotatably mounted to the support plates 80. The pulley has a grooved portion 86 about its circumference for engaging the cable 8. A pair of tubular members 88 and 90 have one of their ends affixed to the base of the U-shaped member 28 and their other ends affixed to a cross bar member 92 located between the sides of the base frame 28 between the back side legs 34 and 36. A plurality of individual weights 18 having a pair of holes 94 and 96 through which the tubular members 88 and 90 pass, are fixed to the tubular members 18 and 90. A pair of shock absorbers 98 and 100 are located beneath the weights 18 to absorb any shock imparted by the weights during the use of the exercising device.

A cable 8 is attached to the lower end 10 of the lever arm assembly 2 and passed beneath the camming means 12 which is restricted in its lateral movement by engagement of the grooved portion 78 around the circumference of the camming means 12. The cable 8 then passes over the pulley 84, again being restrained in its lateral movement by the engagement of grooved portion 86, and then passes downward where the opposite end of the cable is attached to the weights 18. The amount of weight attached to the cable 8 may be selectively determined by a conventional locking arrangement, such as by a pin 102, shown in FIG. 4.

Affixed to the longitudinal female member 64 of the lever arm assembly 2 is an arcuate guide means 22. One end of the arcuate guide means 22 is connected to the lower end 10 of the lever arm assembly 2. The opposite end of the arcuate guide means 22 is connected to a support bar 104 connected to the upper portion of the longitudinal female member 64 of the lever arm assembly 2. The support bar 104 maintains all parts of the arcuate guide means 22 equi-distance from the cylindrical pivoting member 58 about which the lever arm assembly 2 rotates. As shown in greater detail in FIG. 4, in sectional view, the cable 8 is restrained by a path guide 106 on the circumference of the arcuate guide means 22.

The opposite end 24 of the arcuate guide means 22 makes contact with the bottom of the seat cushion 44 thereby restricting movement of the lever arm assembly 2 in a counterclockwise direction when viewed as shown in FIG. 2.

Referring to FIGS. 3 and 4 it may be observed that during operation of the apparatus as the lever arm assembly 2 is moved from position a, such as shown in FIG. 3, to the position b, such as shown in FIG. 4, the camming means 12 rotates about its axis of rotation 14. Since the axis of rotation is not at the center of the cylindrical camming means 12 the camming means 12 moves in an eccentric orbit about the axis of rotation 14. This may be clearly seen as shown by the broken lines in FIG. 4.

Referring to FIG. 1, the effect of the axis of rotation 14 of the camming means 12 being other than at the center may be seen. The initial tangental distance between the axis of rotation 14 and the portion of the cable passing over the pulley 16 is designated as "A." The tangental distance between the axis of rotation 14 and the portion of the cable 8 connected to the lower end of the lever arm 10 is designated as "B." As the camming means 12 rotates about the axis of rotation the tangental distance A and B vary constantly, thereby varying the resistive force applied to the end 10 of the lever arm assembly 2 by the weight 18. Referring to FIG. 4 as the tangental distance A decreases the amount of resistive force applied to the end 10 of the lever arm assembly 2 increases, thereby increasing the amount of force that a user need apply to the lever arm assembly 2 to overcome the weight 18. The arcuate guide means 22 maintains the distance between the cylindrical pivoting number 58 and the cable 8 constant, thereby preventing changes and variation of resistance due to the position of the lever arm assembly.

Figure 7:
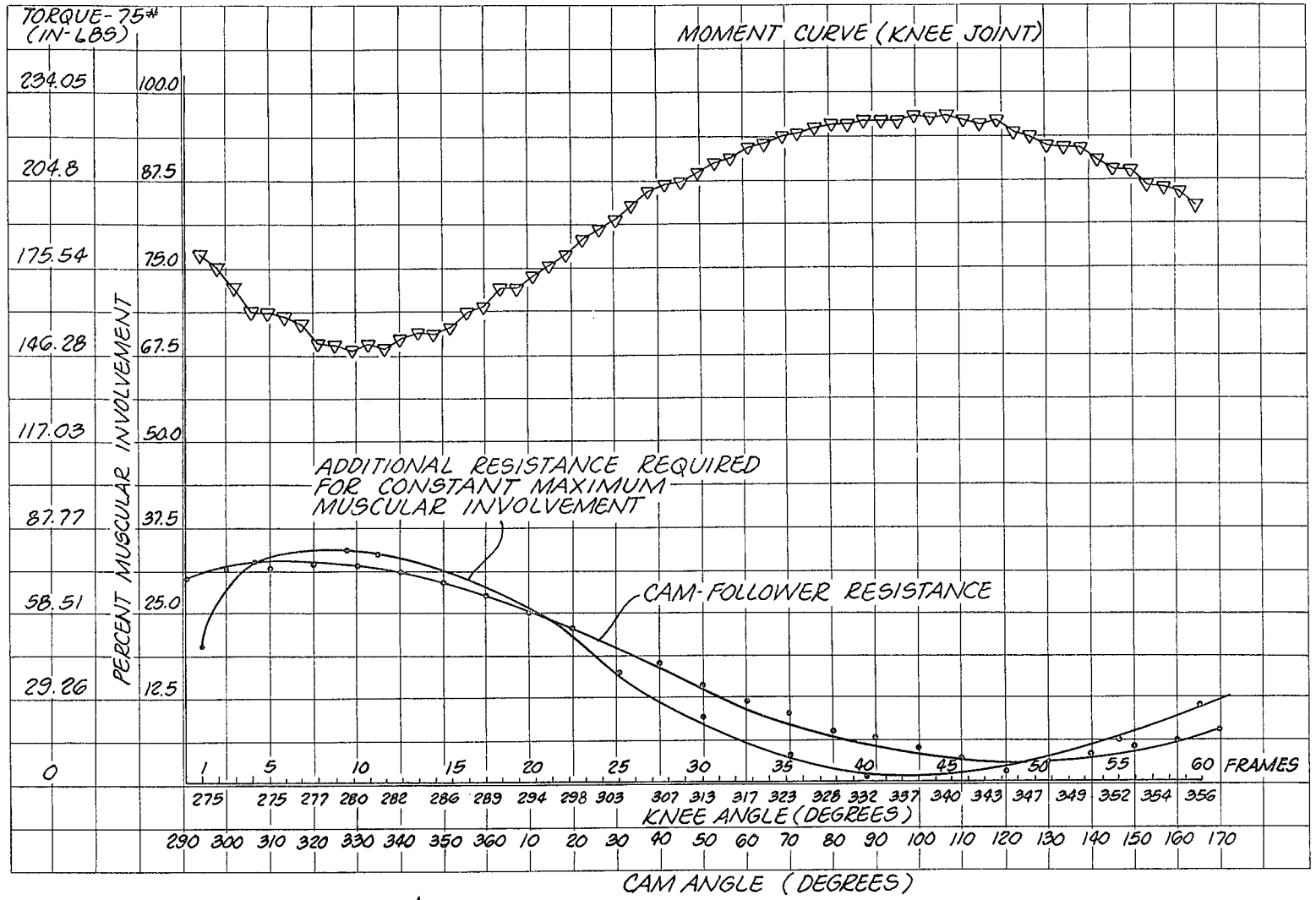
FIG. 7 is a graph displaying the involvement of the muscles associated with the knee joint and the associated resistance curves.

Referring to FIG. 7 the force curves associated with the preferred embodiment of the present invention are shown. The top curve is a plot of the percentage of muscular involvement along the vertical coordinate and the angle at which the knee is extended along the horizontal axis. It is assumed that the fully bent leg forms an angle of 270 degrees and the fully extended leg forms an angle of 360 degrees. As may be seen from FIG. 7 the percentage of muscular involvement as the leg initially begins to move decreases. The percentage then begins to increase until the leg is almost fully extended until, once again, the percentage of muscular involvement in the exercise decreases. The variation in muscular involvement is generally sinusoidal in nature. It is desirable that during those portions at which the muscular involvement is less than the optimum that additional resistive force be added to the lever arm assembly to increase the muscular involvement at that particular position. As the muscular involvement increases the amount of resistive force applied should be decreased since muscular involvement is already at substantially an optimum level.

The lower curves on FIG. 7 illustrate the variation in the resistive force applied to the lever arm assembly 2 due to the camming means 12 and the desired addition resistive force to muscular involvement. It may be observed from FIG. 7 that the resistive force applied to the lever arm assembly 2 is also generally sinusoidal in shape. Matching the generally sinusoidal shape of the resistive force varied by the camming means to the sinusoidal shape of the muscular involvement permits providing constant maximum values of muscular involvement. Reference to the lower horizontal coordinate reference which indicates the degrees of rotation of the camming means 12 should be made for the position of the camming means 12 to provide optimum matching.

In the preferred embodiment of the present invention the camming means 12 rotates a total of 240 degrees. The cam is positioned so that when the lever arm is in its position a, such as shown in FIG. 3, the camming means 12 is starting its rotation at an angular position of 290 degrees and at the lower arm's position B the camming means has rotated until it has reached an angular position of 170 degrees. The curves of FIG. 7 represent the muscular involvement when 75 inch pounds of force of the muscles associated with the knee joint were applied to the lever arm assembly.

Figure 5:
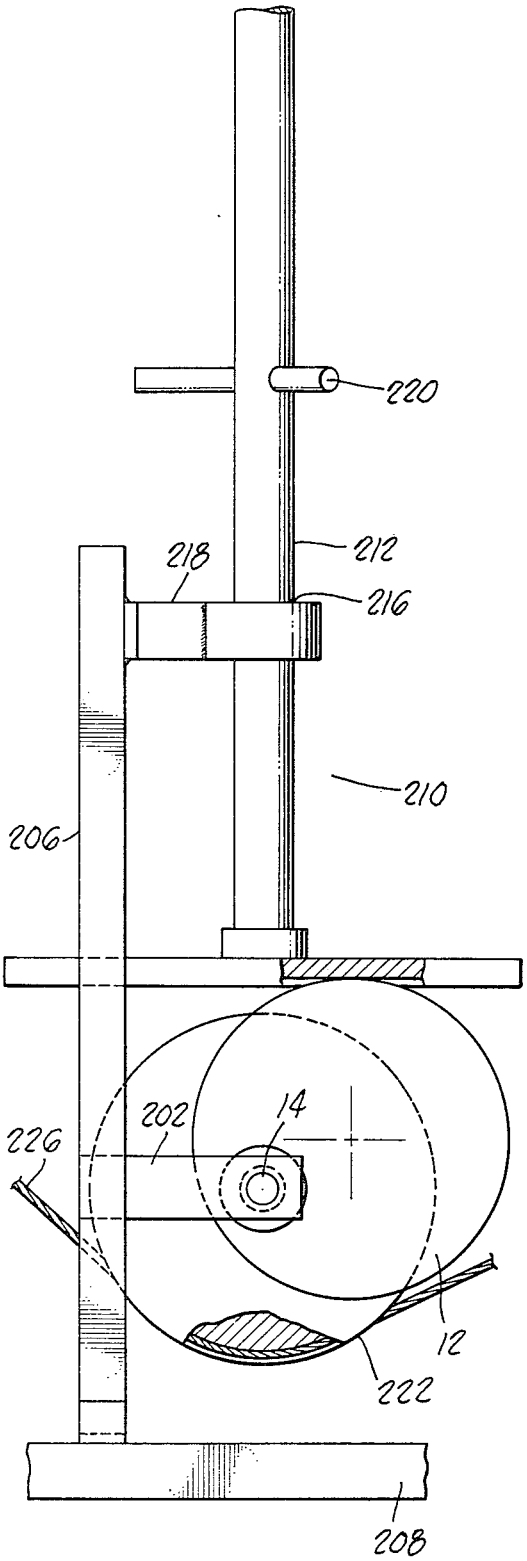
FIG. 5 is a front view of an alternate embodiment of the invention.
Figure 6:
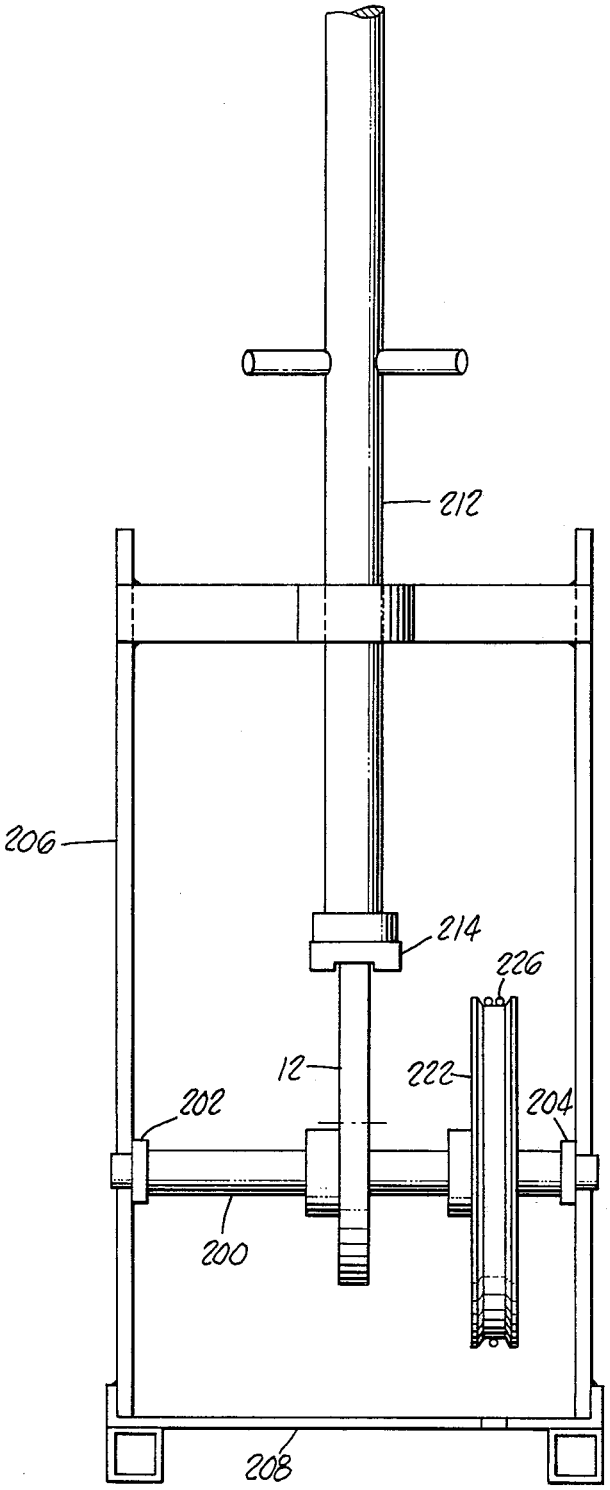
FIG. 6 is a side view of the apparatus of FIG. 5.

Referring to FIGS. 5 and 6 an alternate embodiment of the present invention is disclosed. The camming means 12 is mounted on a shaft 200 about its axis of rotation 14. The shaft 200 is rotatably mounted between support arms 202 and 204 which extends outwardly from a main support frame 206 which may be mounted to a base frame 208 supported by a chair-like structure, not shown.

A follower assembly 210 comprising a tubular member 212 has at its lower end a guide track 214. The guide track 214 encompasses the width of the camming means 12 and moves in a vertical direction responsive to the rotation of the camming means about its axis of rotation 14. The tubular member 212 is passed through a hole 216 in a projection extending outwardly from the support frame 206, 218 to limit its movement to the vertical direction. Above the projection 218 is a bar member 220 passing through the tubular member 212 for supporting weights. The weights (not shown) will apply a restrictive force opposing the rotation of the camming means 12. A pulley 222 is provided on shaft 200, such pulley having a grooved portion 224 for restraining the cable 226 which has one end connected to a lever arm assembly and its other end connected to the weights.

In the operation, the apparatus of the alternate embodiment would be the same as in the preferred embodiment.

While preferred embodiments of the present invention has been disclosed it should be recognized that various modifications may be made which do not defeat the scope of the present invention.

What we claim is:

1. An improved exercising device for exercising the leg of a user, comprising:

a frame member;

a lever arm having one end pivotably connected to a first portion of said frame member and extending downwardly therefrom;

a force transfer member mounted on said lever arm and spaced from said one end thereof; said force transfer member being adapted to be engaged by the front portion of the ankle portion of the foot of a user to pivot said lever arm about said one end thereof;

a pulley member rotatably mounted on a second portion of said frame member; said pulley member having a center point;

means mounting said pulley member to said second portion of said frame member for rotation about an axis spaced from said center point of said pulley member;

weight means mounted on a third portion of said frame member for resisting pivotal movement of said lever arm in one direction; and cable means having one end connected to said lever arm at a point spaced from said one end thereof and an opposite end connected to said weight means; said cable means including a central portion passing around a portion of said pulley member.

2. An improved exercising device according to claim 1, and further comprising an arcuate guide member connected to said lever arm adjacent said one end of said cable means; said arcuate guide member including an arcuate surface which engages and retains said cable means when said lever arm is pivoted.

3. An improved exercising device for exercising the leg of a user, comprising:

frame means for supporting components of said exercising device;

a lever arm having one portion pivotably connected to one portion of said frame means;

a force transfer member on said lever arm and spaced from said one portion thereof; said force transfer member being adapted to be engaged by a portion of the leg or foot of a user to pivot said lever arm about said one portion thereof;

weights operatively associated with said lever arm for resisting pivotal movement of said lever arm in one direction;

a cable having one end connected to said lever arm and an opposite end connected to said weights; said cable having a central portion passing around a portion of said pulley wheel;

said weights resisting pivotable movement of said lever arm in one direction;

a pulley wheel eccentrically mounted on a portion of said frame means for varying the resistance to pivotable movement of said lever arm imposed by said weights.

4. An improved exercising device for exercising the leg of a user, comprising:

frame means for supporting components of said exercising device;

a lever arm having one portion pivotably connected to one portion of said frame means;

a force transfer member on said lever arm and spaced from said one portion thereof; said force transfer member being adapted to be engaged by a portion of the leg or foot of a user to pivot said lever arm about said one portion thereof;

resistance means operatively associated with said lever arm for resisting pivotal movement of said lever arm in one direction;

connecting means operatively connecting said lever arm to said resistance means; said connecting means being connected to said lever arm at a point spaced from said one portion thereof;

said resistance means resisting pivotable movement of said lever arm in one direction;

camming means operatively connected to said connecting means for varying the resistance to pivotable movement of said lever arm imposed by said resistance means; whereby said resistance to pivotable movement increases in a sinusoidal manner until said lever arm is moved to an angular displacement of about 10° from the vertical and decreases from about 10° to 70° of angular displacement from the vertical.

5. An improved exercising device according to claim 3, wherein said connecting means comprises a shaft rotatably connected to said frame means; and wherein said camming means comprises a cam member mounted on said shaft for rotation therewith; and further comprising follower means operatively associated with said cam member and movable thereby as said lever arm is pivoted.

* * * * *